US008141274B2

(12) United States Patent
Matsueda et al.

(10) Patent No.: US 8,141,274 B2
(45) Date of Patent: Mar. 27, 2012

(54) ROWING SHOE

(75) Inventors: Keiji Matsueda, Yamaguchi (JP); Masahiro Ohkoshi, Kyoto (JP); Satoshi Watanabe, Osaka (JP)

(73) Assignee: Shimano Inc., Osaka (JP)

( * ) Notice: Subject to any disclaimer, the term of this patent is extended or adjusted under 35 U.S.C. 154(b) by 429 days.

(21) Appl. No.: 12/471,549

(22) Filed: May 26, 2009

(65) Prior Publication Data

US 2010/0299968 A1 Dec. 2, 2010

(51) Int. Cl.
*A43B 5/00* (2006.01)

(52) U.S. Cl. ..... 36/50.1; 36/50.5; 36/131

(58) Field of Classification Search ..... 36/50.1, 36/50.5, 138, 131, 114
See application file for complete search history.

(56) References Cited

U.S. PATENT DOCUMENTS

| | | | | | |
|---|---|---|---|---|---|
| 177,396 | A * | 5/1876 | Harris | 36/50.1 |
| 201,451 | A * | 3/1878 | Sanford | 36/50.1 |
| 2,297,657 | A * | 9/1942 | Hollier | 36/50.1 |
| 4,081,916 | A * | 4/1978 | Salisbury | 36/50.1 |
| 4,486,965 | A * | 12/1984 | Friton | 36/50.1 |
| RE32,585 | E * | 2/1988 | Antonious | 36/50.1 |
| 5,230,171 | A * | 7/1993 | Cardaropoli | 36/50.1 |
| 5,535,531 | A * | 7/1996 | Karabed et al. | 36/50.1 |
| 5,687,492 | A * | 11/1997 | Muraoka | 36/131 |
| 5,974,701 | A * | 11/1999 | Busch | 36/138 |
| 6,745,500 | B2 * | 6/2004 | Suzuki et al. | 36/50.1 |
| 6,757,991 | B2 * | 7/2004 | Sussmann | 36/50.1 |
| 6,857,204 | B1 * | 2/2005 | Davis et al. | 36/50.1 |
| 7,500,323 | B2 * | 3/2009 | Rasmussen | 36/50.1 |
| 7,752,777 | B2 * | 7/2010 | Hsieh | 36/131 |

* cited by examiner

*Primary Examiner* — Marie Patterson
(74) *Attorney, Agent, or Firm* — Global IP Counselors, LLP

(57) ABSTRACT

A rowing shoe includes a shoe sole and a shoe upper portion. The shoe sole has a cleat mounting portion configured so that a cleat structure is mountable thereto for releasably attaching to a binding structure of a rowing boat. The shoe upper portion includes at least one fixing strap configured to secure the shoe upper portion to a wearer's foot. The fixing strap has a proximal end fixed to the shoe upper portion and a free end having at least one aperture configured so that a pull rope can extend therethrough.

18 Claims, 13 Drawing Sheets

ROWING SHOE

BACKGROUND OF THE INVENTION

1. Field of the Invention

This invention generally relates to rowing shoe. More specifically, the present invention relates to rowing shoes having a fixing strap with a pull rope.

2. Background Information

Rowing is becoming an increasingly more popular form of recreation. Moreover, rowing has become a very popular competitive sport for both amateurs and professionals. Whether rowing is for recreation or competition, the rowing industry is constantly improving the various components of rowing boats and equipment used by rowing enthusiasts. One component that has been extensively redesigned is the rowing shoe.

Rowing shoes preferably include a cleat structure that attaches to a mating binding structure installed within a rowing boat, such as footrest assembly. Thus, the cleat structure of the rowing shoes can include a cleat that releasably attaches to a cleat engaging portion of the binding structure or footrest assembly. Rowing shoes can also include one or more fixing straps with loop and hook fasteners that are used to secure the rowing shoes to the rower's feet.

There are circumstances when a rower desires to remove the rowing shoes quickly while the cleat structure of the rowing shoes is engaged with the binding structure installed within the rowing boat. Under such circumstances, with the rowing shoes having two or more fixing straps, it is time consuming and cumbersome to release each of the fixing straps one-by-one and then remove the rowing shoe from the rowers feet.

In view of the above, it will be apparent to those skilled in the art from this disclosure that there exists a need for an improved rowing shoe with that can be removed from the rower's feet smoothly. This invention addresses this need in the art as well as other needs, which will become apparent to those skilled in the art from this disclosure.

SUMMARY OF THE INVENTION

One object of the present invention is to provide rowing shoes with a smooth release arrangement that provide a means for smoothly releasing straps holding the rowing shoes on the rower's feet.

In accordance with one embodiment of the present invention, a rowing shoe includes a shoe sole and a shoe upper portion. The shoe sole has a cleat mounting portion configured so that a cleat structure is mountable thereto for releasably attaching to a binding structure of a rowing boat. The shoe upper portion includes at least one fixing strap configured to secure the shoe upper portion to a wearer's foot. The fixing strap also has a proximal end fixed to the shoe upper portion and a free end having at least one aperture configured so that a pull rope can extend therethrough.

The foregoing objects can basically be attained by providing a rowing shoe with a shoe sole and a shoe upper portion. The shoe sole has a cleat mounting portion configured so that a cleat structure mountable thereto for releasably attaching to a binding structure of a rowing boat. The shoe upper portion includes at least one fixing strap configured to secure the shoe upper portion to a wearer's foot. The fixing strap has a proximal end fixed to the shoe upper portion and a free end having at least one aperture configured so that a pull rope can extend therethrough.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
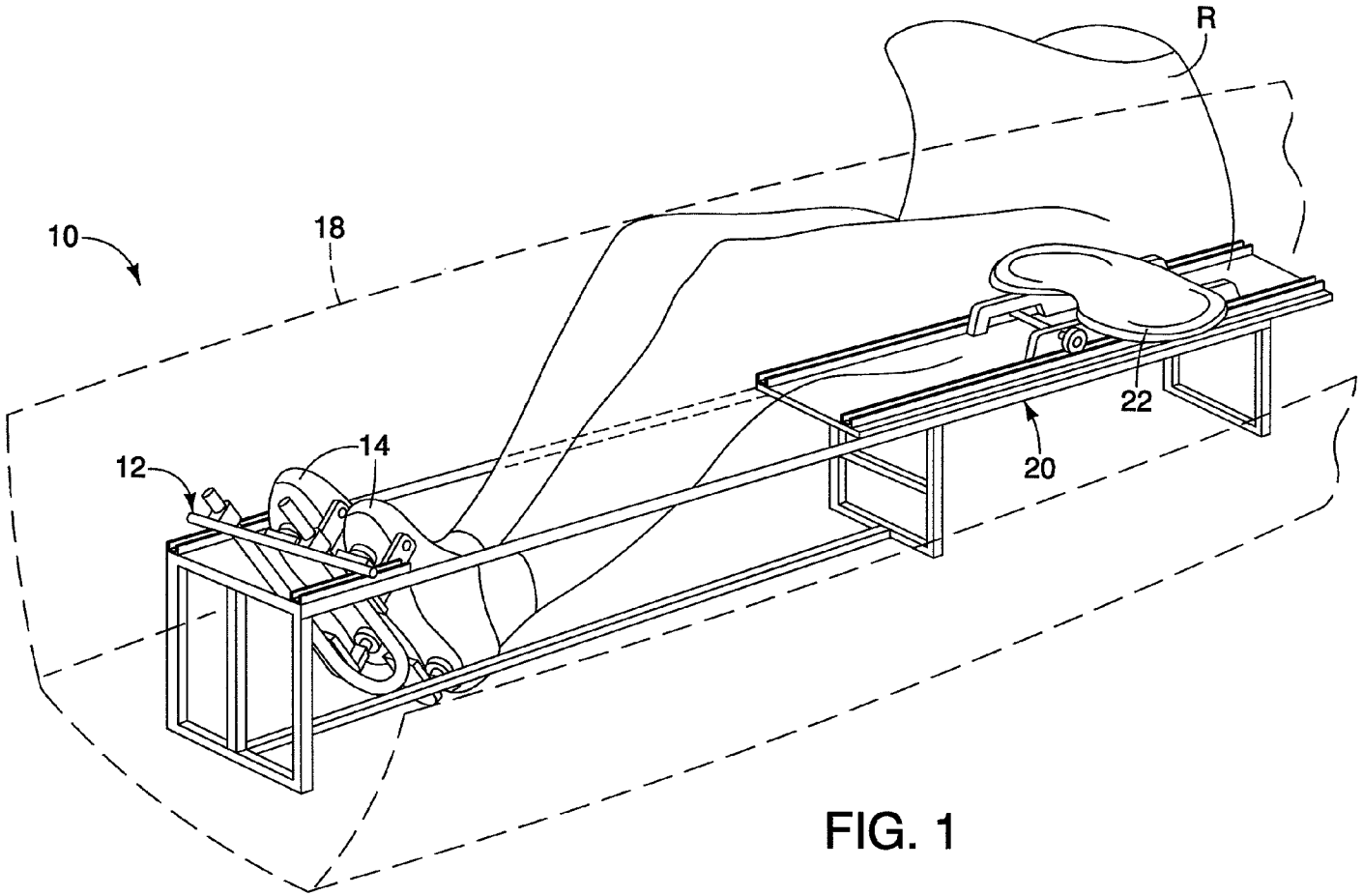
FIG. 1 is a perspective schematic view of a rowing boat that includes a shoe binding structure showing a rower wearing rowing shoes that are releasably secured to the shoe binding structure in accordance with the present invention.

Referring initially to FIG. 1, a rowing boat 10 having a shoe binding structure 12 that releasably secures rowing shoes 14 to the rowing boat 10 is illustrated in accordance with a first embodiment of the present invention.

As is described in greater detail below, the rowing shoes 14 include a pull rope 16 that serves as a smooth release device for rapidly releasing a rower's feet from the rowing shoes 14.

The rowing boat 10 is a conventional rowing boat, such as rowing boats used for leisure activities and/or in competitive sports. For example, the rowing boat 10 can be a sweep-oar boat, a canoe-like water craft, or any boat where one or more of the occupants row and need their feet to be secured within the boat to enhance rowing actions.

The rowing boat 10 basically includes, for example, a hull 18 and a seat structure 20 that supports a rolling seat 22 that movable supports a rower R. The rowing boat 10 also includes the shoe binding structure 12 that is fixedly attached to either the hull 18 of the rowing boat 10 or the seat structure 20. The shoe binding structure 12 works as a mechanism to releasably attach to the rowing shoes 14 such that the rower R can apply both pulling and pushing pressure on the shoe binding structure 12 when rowing. The shoe binding structure 12 can have any of a variety of configurations, such as those disclosed in, for example: co-pending U.S. patent application Ser. No. 12/031,919, filed Feb. 15, 2008, entitled ROWING BOAT FOOTREST ASSEMBLY; co-pending U.S. patent application Ser. No. 12/179,613, filed Jul. 25, 2008, entitled ROWING BOAT FOOT SUPPORT ASSEMBLY; or co-pending U.S. patent application Ser. No. 12/361,594, filed Jan. 29, 2009 entitled ROWING BOAT FOOTREST ASSEMBLY, all assigned to Shimano Inc.

Since the rowing boat 10 and the shoe binding structure 12 are not essential elements for the present invention, further description thereof is omitted for the sake of brevity.

With specific reference to FIGS. 2-11, a detailed description of the rowing shoes 14 is now provided. There are two rowing shoes 14. However, the rowing shoes 14 are identical to one another except that they are mirror images of one another, one for the left foot and one for the right foot. Accordingly, description of one of the shoes 14 applies equally to the other of the shoes 14. Therefore, description will be provide for only one of the rowing shoes 14, but applies equally to both rowing shoes 14.

Figure 2:
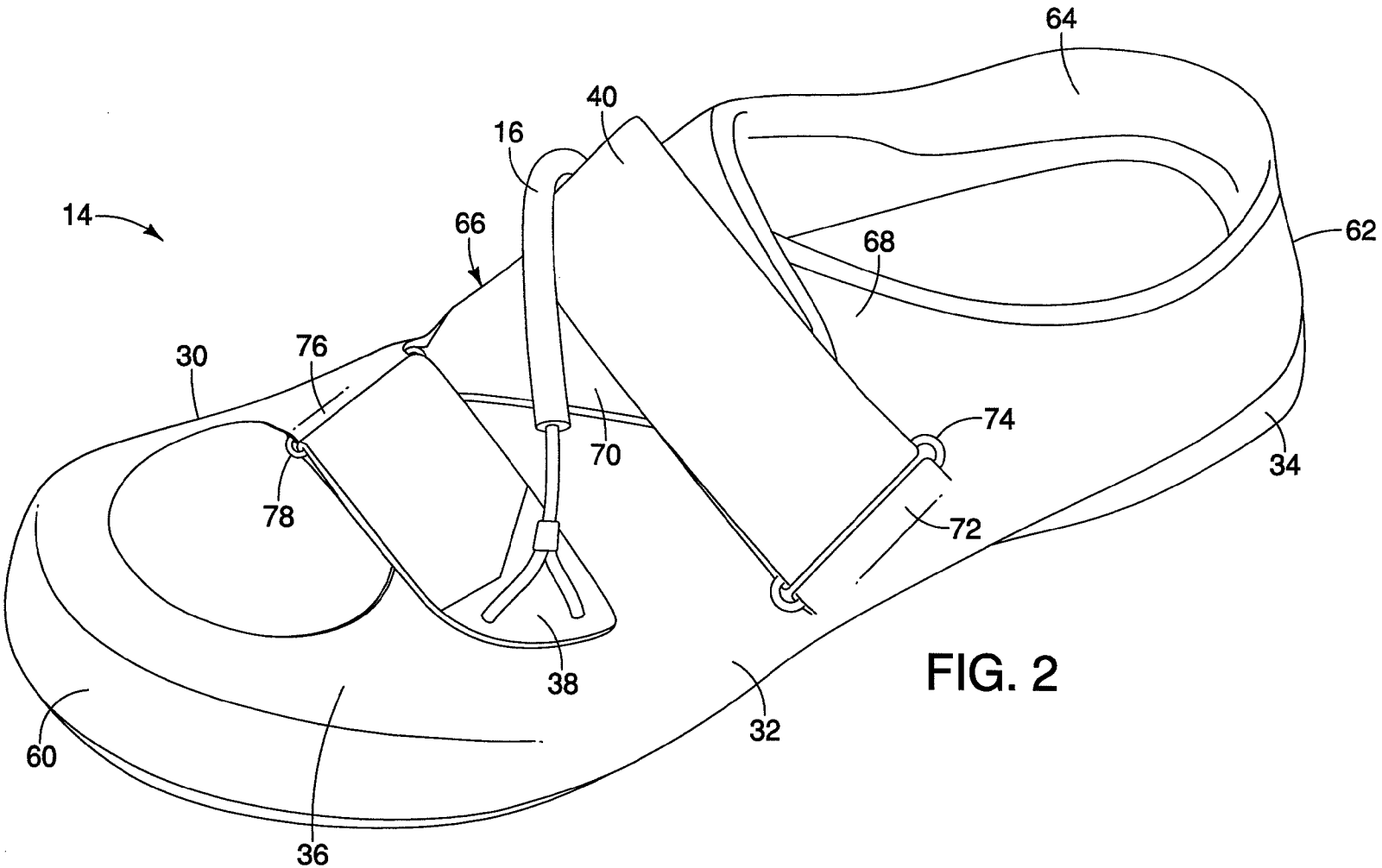
FIG. 2 is a perspective view of the rowing shoe depicted in FIG. 1 shown removed from the rower's foot and removed from the shoe binding structure showing a pair of straps and a pull rope fixed to respective ends of the pair of straps in accordance with a first embodiment of the present invention.

As shown in FIG. 2, the rowing shoe 14 includes an inboard side 30, an outboard side 32, a sole 34, a shoe upper portion 36, a first strap 38 and a second strap 40. It should be understood from the drawings and the description herein that the term inboard side refers to the right side of a shoe for the left foot, and the left side of a shoe for the right foot. In other words the inboard side is the side of the shoe facing the shoe on the other foot of the wearer. Similarly, the term outboard side refers to the left side of the shoe for the left foot and the right side of the shoe for the right foot. The outboard side is the side of the shoe facing away from the shoe on the other foot. As well, the terms inner side and inboard side are used interchangeably with respect to the present invention. Similarly, the terms outer side and outboard side are also used interchangeably with respect to the description of the present invention.

Figure 3:
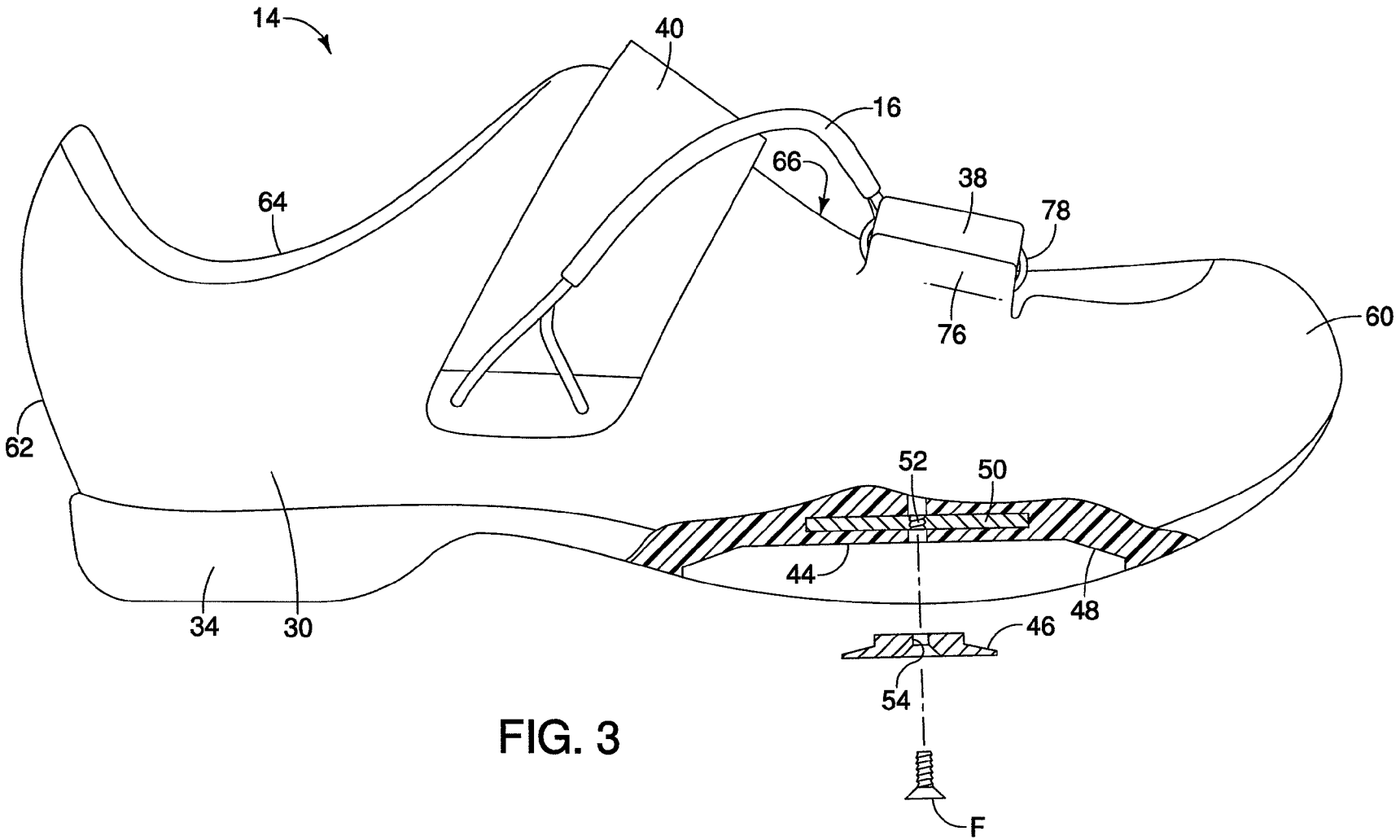
FIG. 3 is a side elevational view with a cut-away cross-section of an inboard side of the rowing shoe depicted in FIG. 2, showing a cleat mounting portion and a cleat structure and also showing a free end of one of the pair of straps in accordance with the first embodiment of the present invention.
Figure 6:
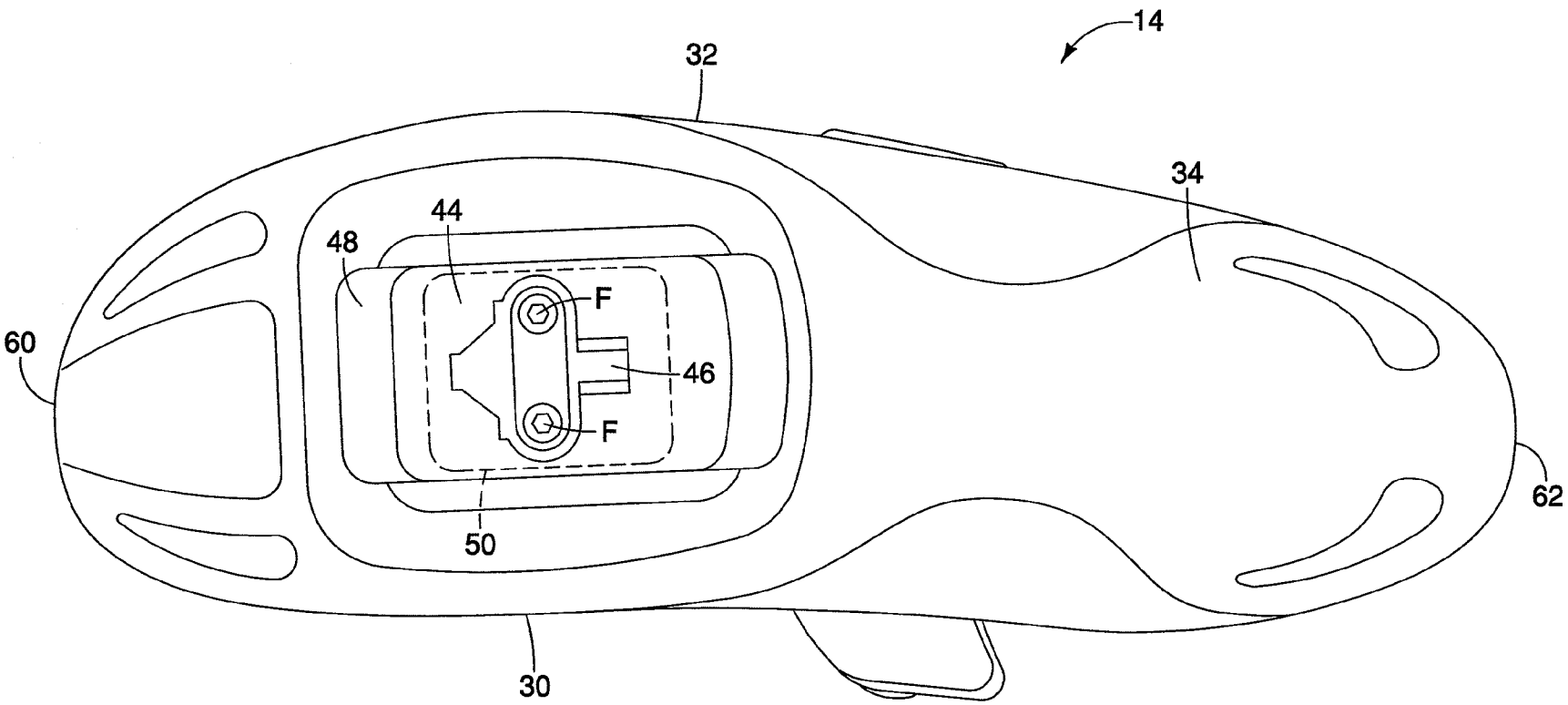
FIG. 6 is a bottom plan view of the rowing show depicted in FIGS. 2-5, showing the cleat structure and the shoe sole in accordance with the first embodiment of the present invention.

As shown in FIGS. 3 and 6, the sole 34 includes a cleat mounting portion 44 that is configured so that a cleat structure 46 is mountable thereto. As best shown in FIG. 3 in cross-section, the sole 34 is made of a resilient but relatively rigid polymer or plastic material (with some small degree of resilient flexibility). Also shown in FIG. 3, the cleat mounting portion 44 includes a recess 48 and a reinforcement part 50. The recess 48 is dimensioned to receive the cleat structure 46 and with plenty of surrounding space to allow for conventional releasable attachment of the cleat structure 46 to the shoe binding structure 12 with no interference from the remainder of the sole 34. The reinforcement part 50 is preferably embedded within the sole 34 and includes a pair of threaded hole 52 (only one shown in FIG. 3) dimensioned to receive a pair of fasteners F that secure the cleat structure 46 to the sole 34, as shown in FIG. 6. The cleat structure 46 also includes two apertures 54 (only one aperture 54 is shown in FIG. 3) that receive the fasteners F.

As best shown in FIGS. 2-5 and 7-9, the shoe upper portion 36 includes a toe end 60, a heel end 62, a foot opening 64, a securing section 66, an under-lapping section 68 and an overlapping section 70. It should also be understood from the drawings and the description herein that the shoe upper portion 36 at least partially defines the inboard side 30 and the outboard side 32 of the rowing shoe 14. Hence, the terms inboard side 30 and the outboard side 32 refer to both the rowing shoe 14 and the shoe upper portion 36. Preferably, the foot opening 64 is sized widely in comparison with conventional sports shoes used in other sports, especially in an anteroposterior direction of the rowing shoe 14, to avoid disturbing the movement of a rower's R ankle during rowing action.

The shoe upper portion 36 is preferably made from any of a plurality of materials or combination of materials, such as leather, leather-like materials, polymer materials, plastic materials and textile materials. For instance, in some embodiments, the shoe upper portion 36 can include sections made of waterproof materials and other sections made of air permeable materials that allow for the interior of the rowing shoe 14 to breath or ventilate. The various sections of the shoe upper portion 36 are stitched or otherwise fixed to one another. Since the present invention is applicable to a variety of differing shoe styles, designs and configuration, the depicted embodiment shows a basic shoe design that is made of several textile based materials that are sewn or stitched together to form the depicted shape. However, the present invention is not limited to the depicted shape, as will be understood from the description of the present invention below. The shoe upper portion 36 is fixed to the sole 34 in a conventional manner, such as with stitching, adhesives, and/or embedding portions thereof within the sole 34.

Figure 5:
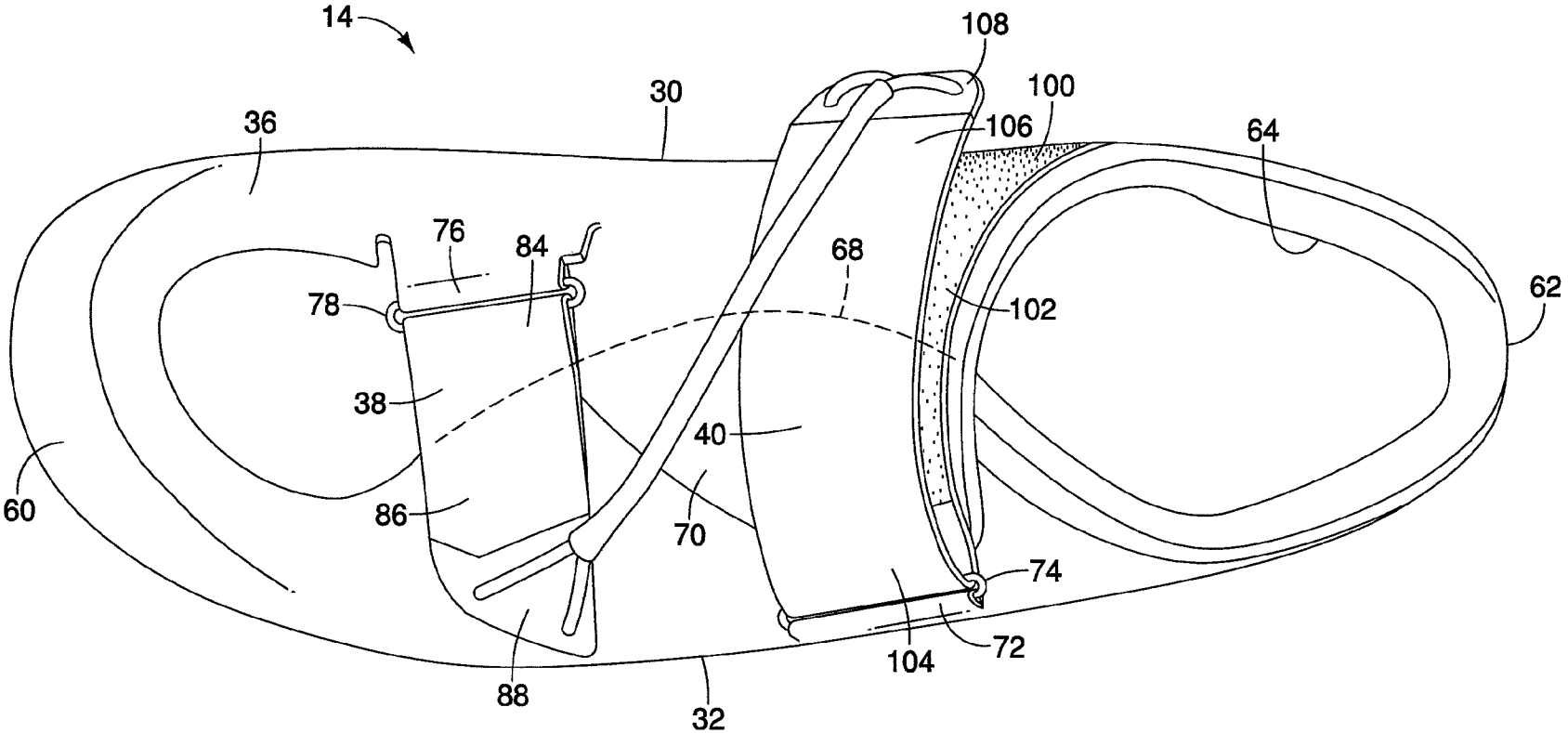
FIG. 5 is a top plan view of the rowing shoe depicted in FIGS. 2, 3 and 4, showing the free ends of both of the pair of straps in accordance with the first embodiment of the present invention.

As is best indicated in FIG. 5, the under-lapping section 68 is basically an elongated portion of the outboard side 32 of the shoe upper portion 36 that extends upward from the sole 34. The under-lapping section 68 can be dimensioned to extend to and over the top of the rower's R foot, when the rower R is wearing the rowing shoe 14. The actual size and length of the under-lapping section 68 can vary depending upon the overall shoe design and is not limited to the depicted relative dimensions and shape.

Figure 4:
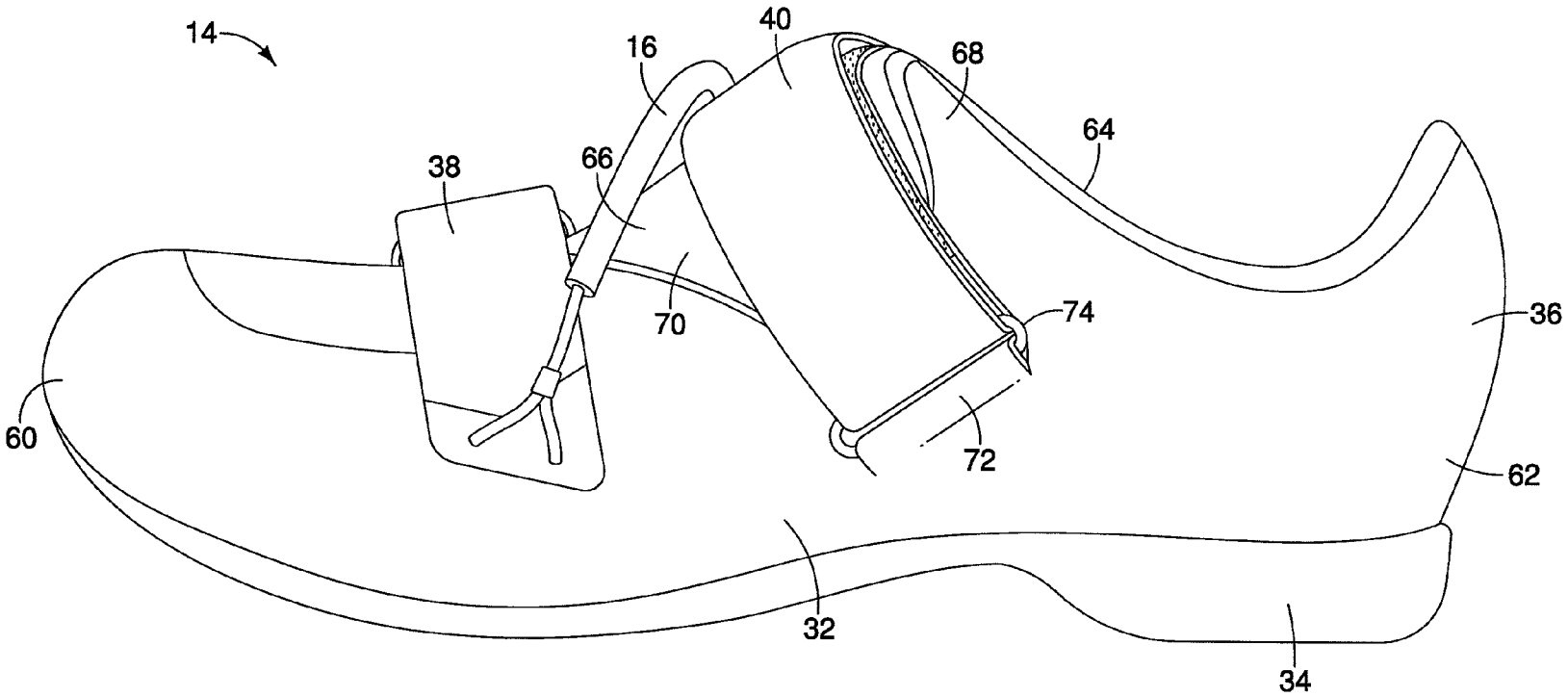
FIG. 4 is a side elevational view of an outboard side of the rowing shoe depicted in FIGS. 2 and 3, showing a free end of another of the pair of straps in accordance with the first embodiment of the present invention.

As best shown in FIGS. 2 and 4, the under-lapping section 68 includes a loop section 72 that loops around a second strap ring 74. The loop section 72 is preferably located adjacent to but spaced apart from the sole 34 on the outboard side 32 of the shoe upper portion 36. The loop section 72 is securely fixed to the outboard side of the shoe upper portion 36 via a sewn seam or stitching. Alternatively, the loop section 72 and the under-lapping section 68 can be formed from a single element or section, with a portion of the loop section 72 partially cut out from the under-lapping section 68 and then sewn or stitched to itself forming a loop. The loop section 72 encircles one portion of the second strap ring 74, as shown in FIGS. 2 and 4. The second strap ring 74 is a rigid ring-like member, such as metallic member, that has an overall rectangular shape with a central aperture that receives the loop section 72 and a portion of the second strap 40, as described in greater detail below.

In the depicted embodiment, the overlapping section 70 of the shoe upper portion 36 is basically an elongated portion of the inboard side 30 of the shoe upper portion 36. More specifically, the material that forms the inboard side 30 of the shoe upper portion 36 is sufficiently long to enable the overlapping section 70 to extend over the top of the rowing shoe 14 and overlie at least a portion the under-lapping section 68 with the first and second straps 38 and 40 properly tightened around the rower's foot.

As best shown in FIGS. 2, 3, 5, 7 and 8, the overlapping section 70 includes a loop section 76 that loops around a first strap ring 78. The loop section 76 is preferably spaced apart from the sole 34 adjacent to the inboard side 30 of the shoe upper portion 36. More specifically, the loop section 76 is located on an upper surface of the shoe upper portion 36 closer to the toe end 60 than to the foot opening 64.

The loop section 76 is securely fixed to the shoe upper portion 36 via a sewn seam or stitching. Alternatively, the loop section 76 and the overlapping section 70 can be formed from a single element or section, with a portion of the loop section 76 partially cut out from the overlapping section 70 and then sewn or stitched to itself forming a loop. The loop section 76 encircles one portion of the first strap ring 78. The first strap ring 78 is a rigid ring-like member, such as a metallic member, that has an overall rectangular shape with a central aperture that receives the loop section 76 and a portion of the first strap 38, as described in greater detail below.

The first strap 38 and the second strap 40 of the shoe upper portion 36 are configured to secure the shoe upper portion 36 to the foot of the rower R.

Figure 8:
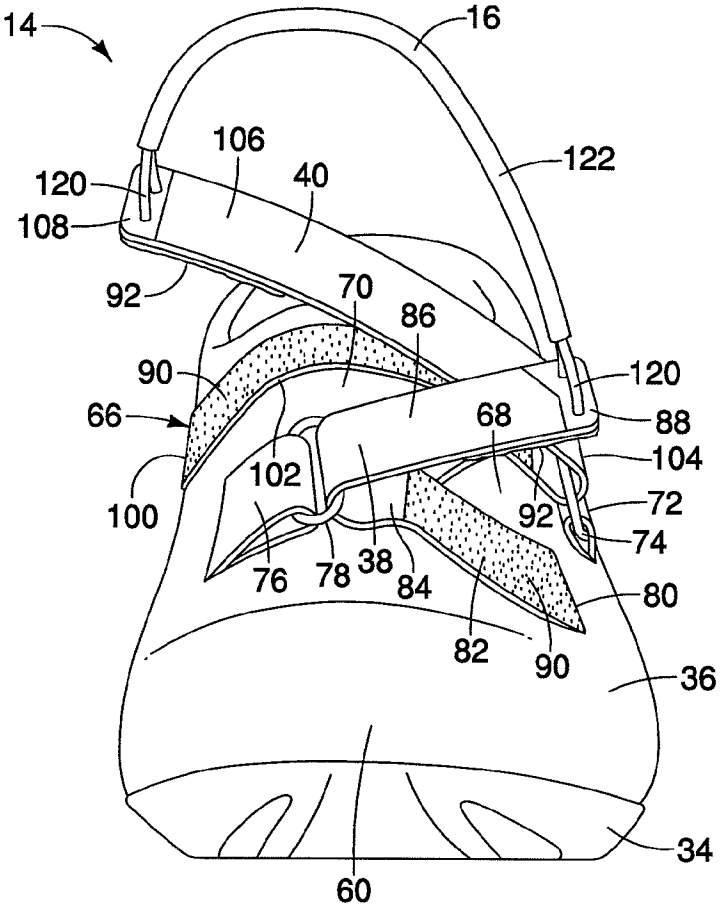
FIG. 8 is another front view of the rowing shoe depicted in FIGS. 2-6 showing the pair of straps loosened by pulling the pull rope in accordance with the first embodiment of the present invention.
Figure 7:
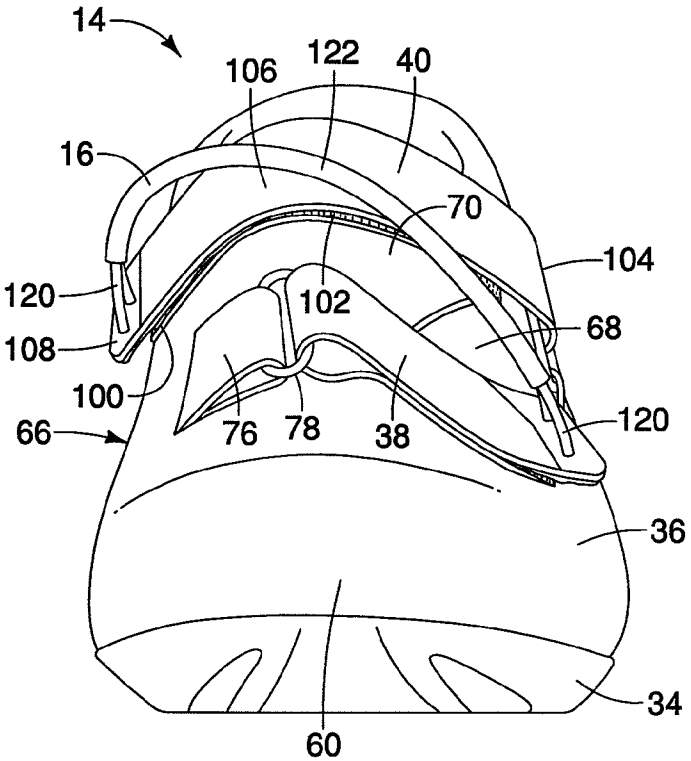
FIG. 7 is a front view of the rowing shoe depicted in FIGS. 2-6 showing the pair of straps tightened in accordance with the first embodiment of the present invention.
Figure 9:
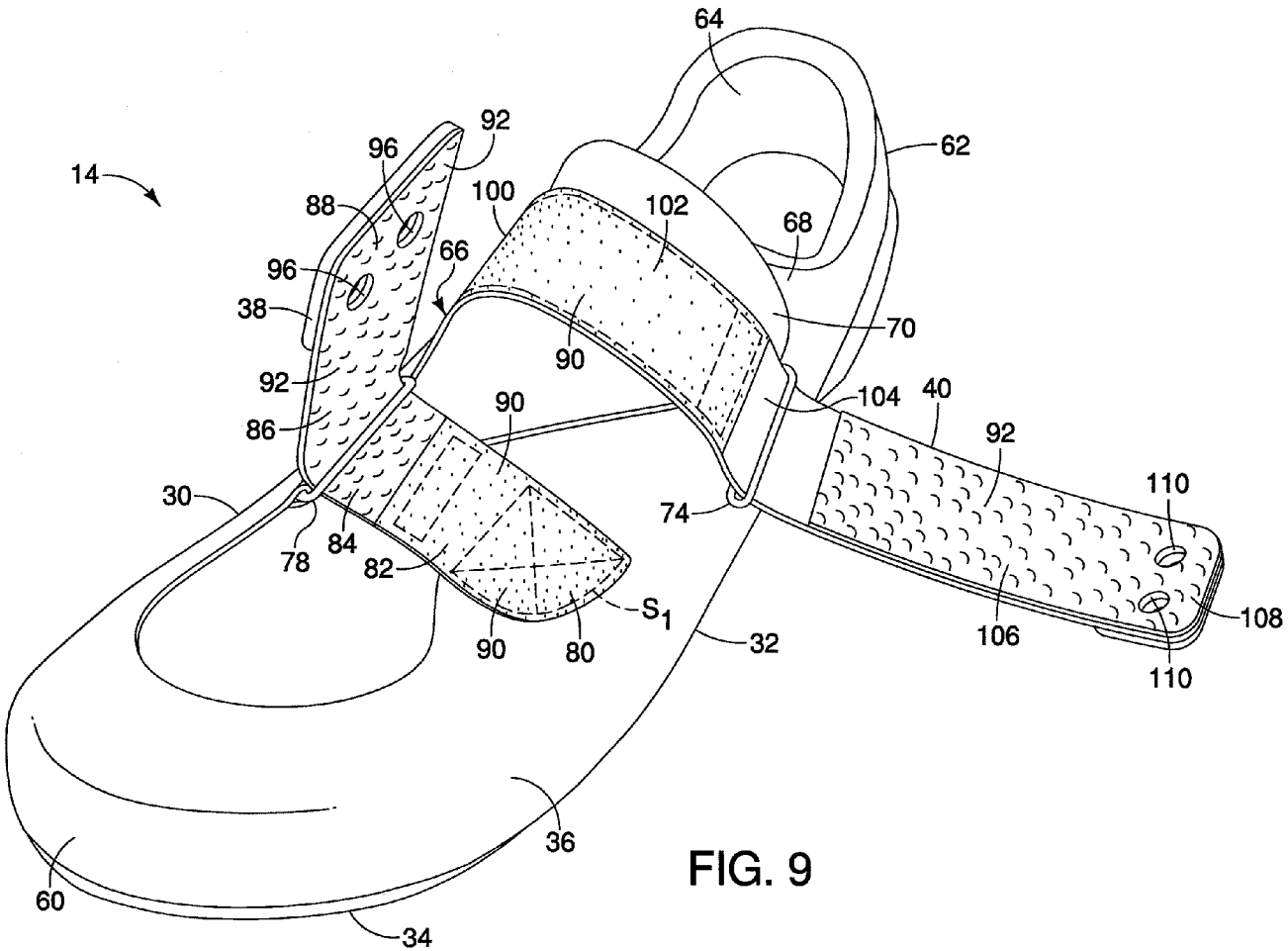
FIG. 9 is another perspective view of the rowing shoe showing a first of the pair of straps and a second of the pair of straps with the pull rope removed, both straps loosened to reveal a loop and hook fastening materials in accordance with the first embodiment of the present invention.
Figure 11:
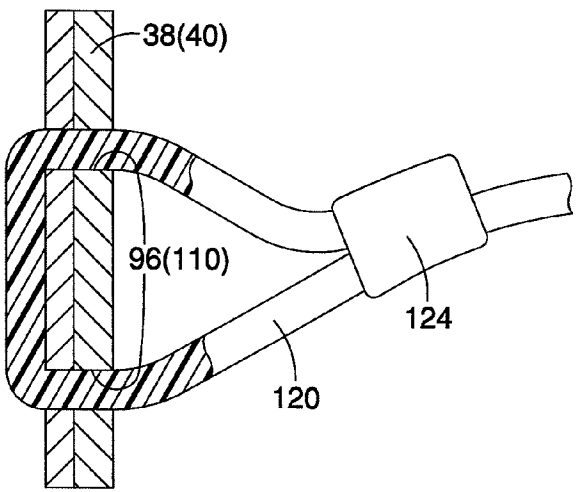
FIG. 11 is a cross sectional view of the one of the pair of straps taken along the line 11-11 in FIG. 10, showing the looped portion of the pull rope extending through the two holes in the strap in accordance with the first embodiment of the present invention.
Figure 10:
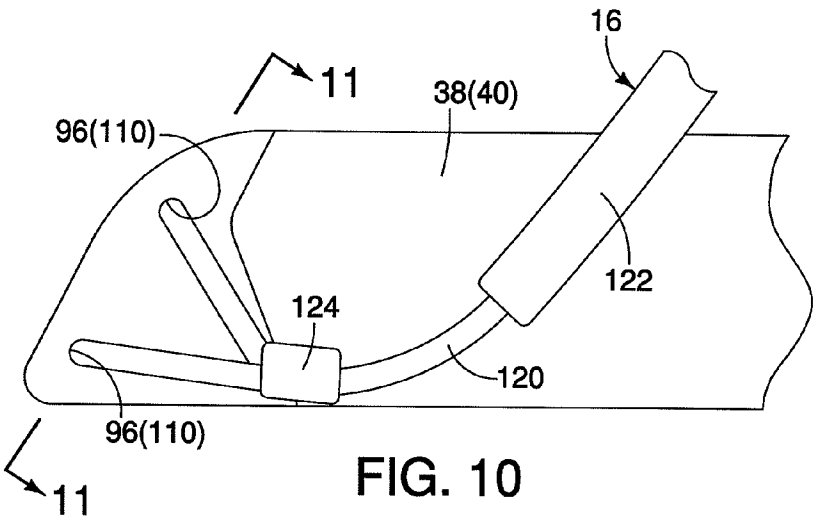
FIG. 10 is an enlarged view of one of the pair of straps of the rowing shoe, showing a pair of holes with one end of the pull rope looped through the pair of holes in accordance with the first embodiment of the present invention.
Figure 12:
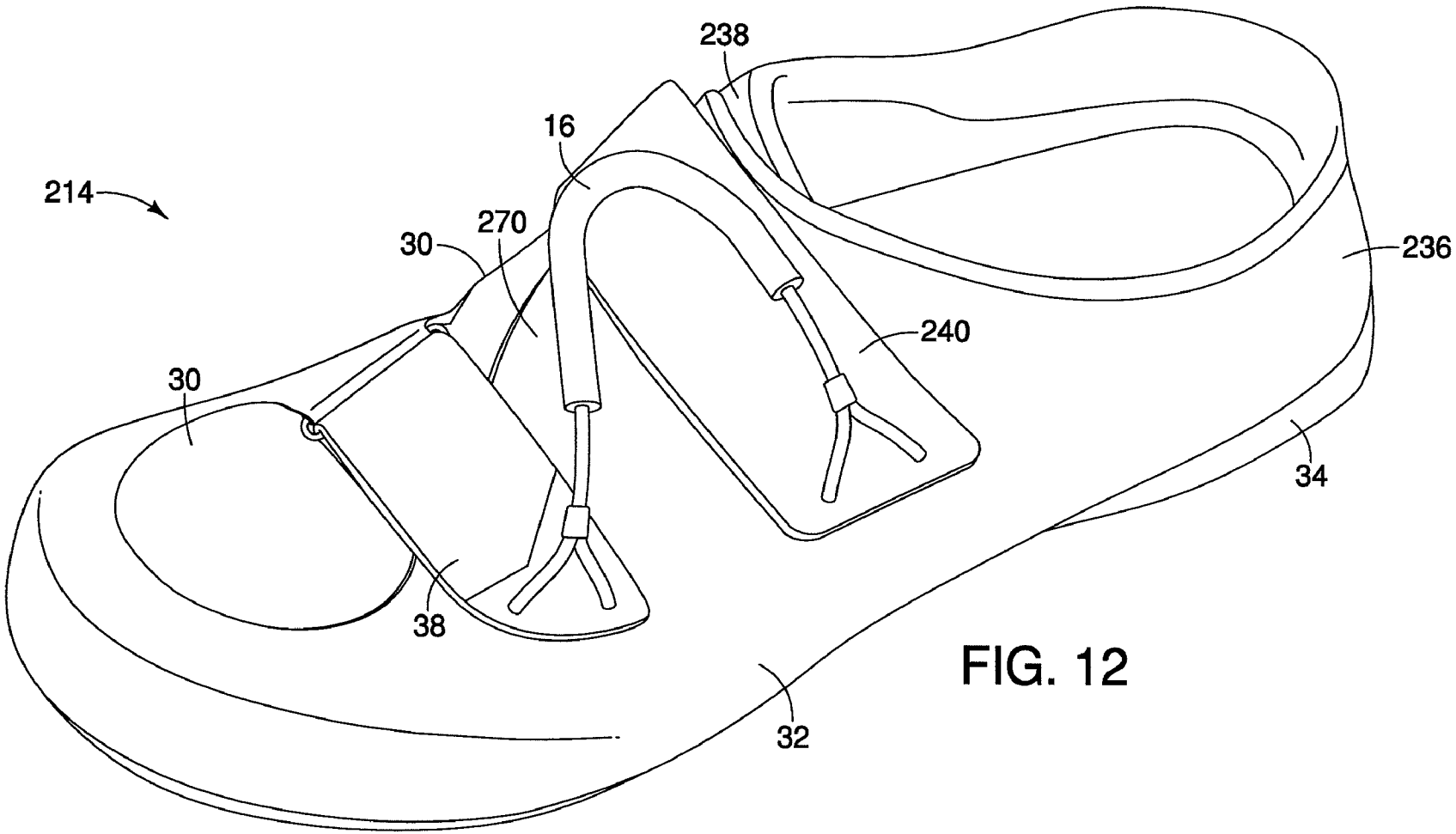
FIG. 12 is a perspective view of a rowing shoe shown removed from the rower's foot and removed from the shoe binding structure showing a pair of straps and a pull rope fixed to respective ends of the pair of straps in accordance with a second embodiment of the present invention.
Figure 13:
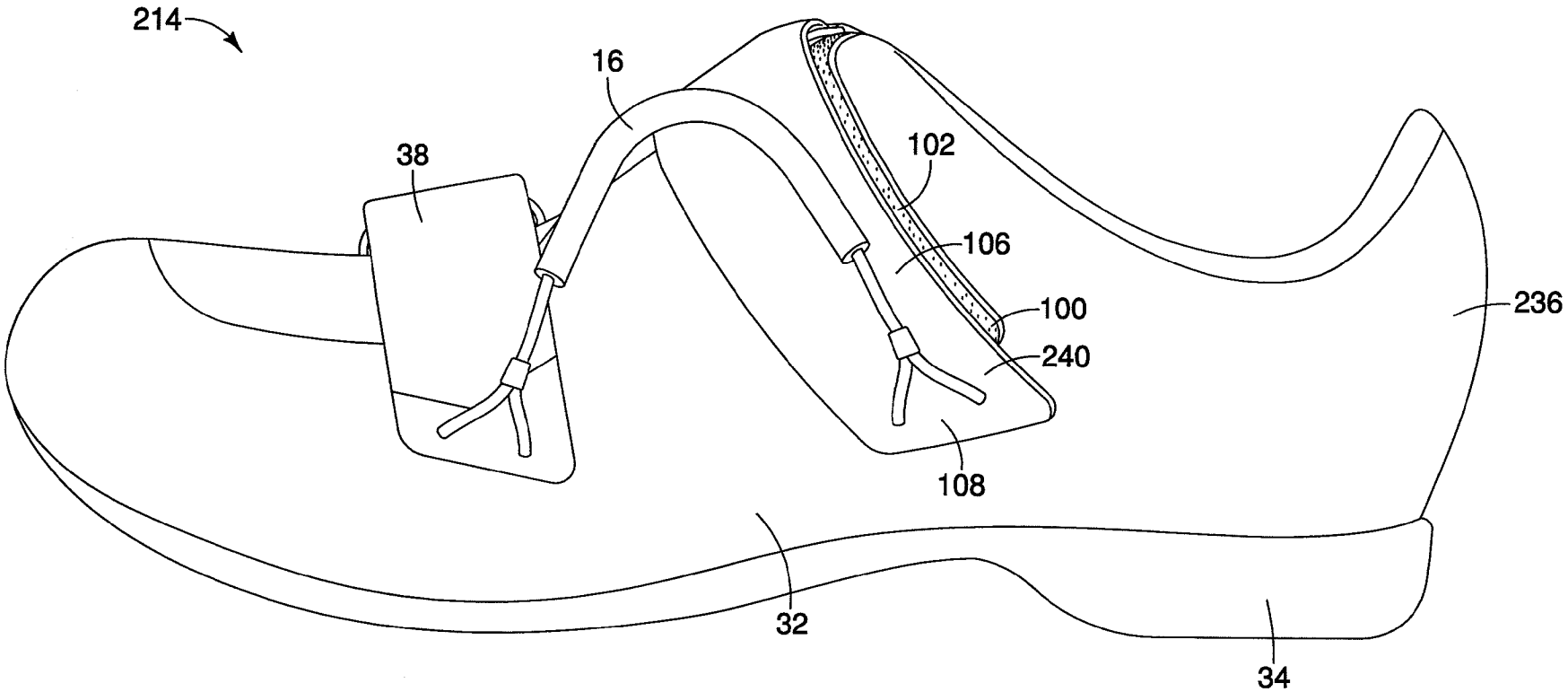
FIG. 13 is a side elevational view of an outboard side of the rowing shoe depicted in FIG. 12, showing free ends of the pair of straps in accordance with the second embodiment of the present invention.

As best shown in FIGS. 7-9, the first strap 38 includes a proximal end 80, a first fastener section 82, a looping section 84, a second fastener section 86 and a free end 88. The first strap 38 is a first fixing strap, fixing the rowing shoe 14 on the rower's foot. The proximal end 80 is located at the outboard side 32 of the shoe upper portion 36 on the under-lapping section 68, as best shown in FIG. 9. The proximal end 80 is preferably positioned closer to the toe end 60 of the shoe upper portion 36 than the foot opening 64. The proximal end 80 is fixed to the shoe upper portion 36 by sewing or stitching $S_1$, as indicated in FIG. 9 in dashed lines. The proximal end 80 and the first fastener section 82 overlie the top of the rowing shoe 14 near the toe end 60.

The first fastener section 82 and the proximal end 80 include a first material 90 of loop and hook fastening materials. The first strap 38 is fed through and extends through the first strap ring 78 such that the looping section 84 of the first strap 38 usually contacts the first strap ring 78. The looping section 84, the second fastener section 86 and the free end 88 include a second material 92 of the loop and hook fastening materials. Consequently, when the free end 88 of the first strap 38 is pulled from the inboard side 30 of the rowing shoe 14 toward the outboard side 32 of the rowing shoe 14 after extending through the first strap ring 78, the looping section 84 interacts with the first strap ring 78 to draw the outboard side 32 and the inboard side 30 of the shoe upper portion 36 toward one another. When the second fastener section 86 is brought into contact with the first fastener section 82, the first and second materials 90 and 92 of the loop and hook fastener materials secure the first strap 38 in a tightened orientation, as shown in FIGS. 2-5 and 7.

The free end 88 of the first strap 38 includes a pair of apertures 96 that are configured so that the pull rope 16 can extend therethrough, as described in greater detail below.

As best shown in FIGS. 7-9, the second strap 40 includes a proximal end 100, a first fastener section 102, a looping section 104, a second fastener section 106 and a free end 108. The second strap 40 is a second fixing strap, fixing the rowing shoe 14 on the rower's foot. The proximal end 100 is located at the inboard side 30 of the shoe upper portion 36 on the overlapping section 70, as best shown in FIGS. 7 and 8. The proximal end 100 is preferably positioned closer to the foot opening 64 of the shoe upper portion 36 than the toe end 60. The proximal end 100 is fixed to the shoe upper portion 36 by sewing or stitching. The proximal end 100 and the first fastener section 102 overlie the top of the rowing shoe 14 and a portion of the overlapping section 70 near the foot opening 64.

The first fastener section 102 and the proximal end 100 include more of the first material 90 of loop and hook fastening materials. The second strap 40 is fed through and extends through the second strap ring 74 such that the looping section 104 of the second strap 40 usually contacts the second strap ring 74. The looping section 104, the second fastener section 106 and the free end 108 include more of the second material 92 of the loop and hook fastening materials. Consequently, when the free end 108 of the second strap 40 is pulled from the outboard side 32 of the rowing shoe 14 toward the inboard side 30 of the rowing shoe 14 after extending through the second strap ring 74, the looping section 104 interacts with the second strap ring 74 to draw the outboard side 32 and the inboard side 30 of the shoe upper portion 36 toward one another. Further, the overlapping section 70 is pulled over a large portion of the under-lapping section 68. When the second fastener section 106 is brought into contact with the first fastener section 102, the first and second materials 90 and 92 of the loop and hook fastener materials secure the second strap 40 in a tightened orientation.

The free end 108 of the second strap 40 also includes a pair of apertures 110 that are configured so that the pull rope 16 can extend therethrough, as described in greater detail below.

A description of the pull rope 16 is now provided with specific reference to FIGS. 7, 8, 10 and 11. The pull rope 16 is basically a smooth release device that includes a rope portion 120 and a grip portion 122. The rope portion 120 can be made of any material, such as synthetic fibers, hemp, textile or other material suitable for making rope or lace constructions. Preferably, the rope portion 120 is looped at one end through the apertures 96 at the free end 88 of the first strap 38 and looped at another end through the apertures 96 of the free end 108 of the second strap 40 as shown in the first embodiment. The looped ends of the rope portion 120 can be fixed by a clamp 124 shown in FIGS. 10 and 11. Alternatively, the looped ends of the rope portion 120 can be secured with a knot. The clamp 124 can be a metallic ring, deformed to hold the looped section of the rope portion 120 together. Alternatively, the clamp 124 can be a molded plastic member or other suitable clamping material to hold the looped section of the rope portion 120 together.

The grip portion 122 is preferably a hollow metallic tubular member with the rope portion 120 extending therethrough. The grip portion 122 preferably has greater rigidity than the rope portion 120 such that the grip portion 122 retains an overall C-shape or handle-like shape for easy grasping. However the grip portion 122 can be manufacture to have some resiliency and a bit of flexibility. Therefore, the grip portion 122 can alternatively be made of a plastic or polymer material.

Accordingly, the pull rope 16 extends between the free ends 88 and 108 of respective ones of the first and second fixing straps 38 and 40.

The first strap 38 is fixedly attached to the shoe upper portion 36 and is releasably attachable to the first fastener section 82 (a first attachment section) on the shoe upper portion 36 so as to tighten the shoe upper portion 36 to the wearer's foot when the free end 88 of the first strap 38 is pulled from the inboard side 30 of the rowing shoe 14 toward the outboard side 32 of the rowing shoe 14 after extending through the first strap ring 78.

The first strap 38 is released from the first fastener section 82 (the first attachment section) when the free end 88 of the first strap 38 is pulled from the outboard side 32 of the rowing shoe 14 toward the inboard side 30 of the rowing shoe 14.

The second strap 40 is fixedly attached to the shoe upper portion 36 and is releasably attachable to the second fastener section 106 (a second attachment section) on the shoe upper portion 36 so as to tighten the shoe upper portion 36 to the wearer's foot when the free end 108 of the second strap 40 is pulled from the outboard side 32 of the rowing shoe 14 toward the inboard side 30 of the rowing shoe 14 after extending through the second strap ring 74.

The second strap 40 is released from the second fastener section 106 (the second attachment section) when the free end 108 of the second strap 40 is pulled from the inboard side 30 of the rowing shoe 14 toward the outboard side 32 of the rowing shoe 14. Because the space outboard from the rowing shoe 14 is typically less than the space between the right and left rowing shoes 14 especially in a competitive rowing boat, it is easier for a rower to release the second strap 40 in the above-mentioned manner in connection with the first embodiment.

It should be noted that the first strap 38 has a first length measured from the proximate end 80 (an attachment point) where the first strap 38 attaches to the shoe upper portion 36 to the free end 88 thereof. Further the second strap 40 has a second length measured from the proximate end 100 (an attachment point) where the second strap 40 attaches to the shoe upper portion 36 to the free end 108 thereof, the second length is greater than the first length. In other words, the second strap 40 is longer than the first strap 38.

Second Embodiment

Referring now to FIGS. 12-15, a rowing shoe 214 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

In the second embodiment, the rowing shoe 214 has many of the features of the rowing show 14 of the first embodiment. For example, the rowing shoe 214 includes the pull rope 16, the inboard side 30, the outboard side 32, the sole 34, the first strap 38 and the first strap ring 78. However, in the second embodiment, the rowing shoe 214 includes a shoe upper portion 236 that is a modification of the shoe upper portion 36 of the first embodiment. Further, in the second embodiment, the rowing shoe 214 also includes a second strap 240 that is a modification of the second strap 40 of the first embodiment. The second strap 240 extends through a second strap ring 274, in a manner similar to the second strap 40 and the second strap ring 74 of the first embodiment.

Figure 14:
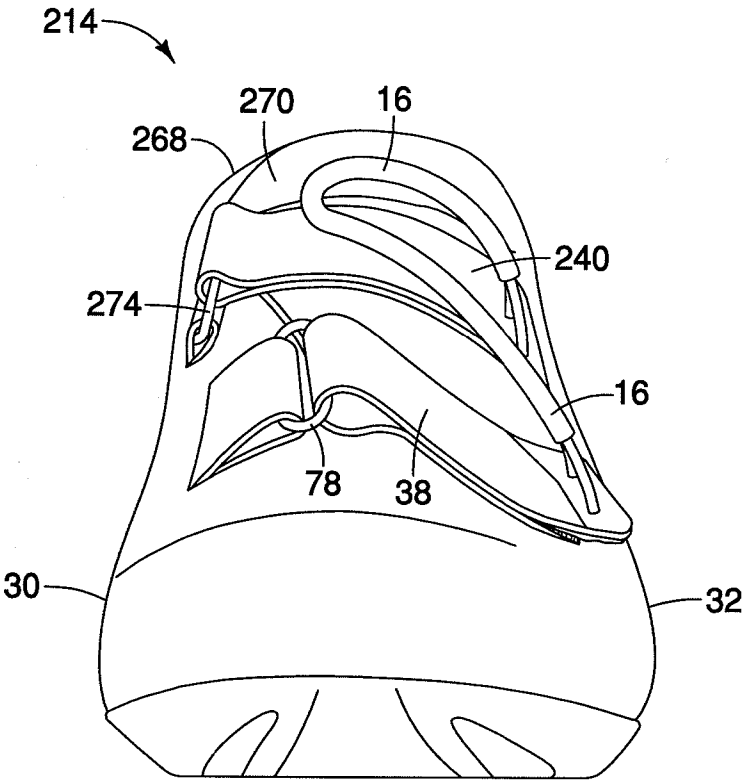
FIG. 14 is a front view of the rowing shoe depicted in FIGS. 12 and 13 showing the pair of straps tightened in accordance with the second embodiment of the present invention.

In the second embodiment, the first strap 38 is fixedly attached to the shoe upper portion 236 in a manner that is the same in the first embodiment. Specifically, the first strap 38 is releasably attachable to the shoe upper portion 236 so as to tighten the shoe upper portion 236 to the wearer's foot when the free end 88 of the first strap 38 is pulled from the inboard side 30 of the rowing shoe 214 toward the outboard side 32 of the rowing shoe 214 after extending through the first strap ring 78, as indicated in FIGS. 14 and 15.

However, in the second embodiment, the second strap 240 is attached to the shoe upper portion 236 in a manner that is opposite the second strap 40 of the first embodiment. Specifically, the second strap 240 is fixedly attached to the shoe upper portion 236 and an overlapping section 270. The overlapping section 270 extends from the outboard side 32 of the shoe 214, opposite the overlapping section 70 of the first embodiment. The second strap 240 is releasably attachable to the shoe upper portion 236 so as to tighten the shoe upper portion 236 to the wearer's foot when the free end 108 of the second strap 240 is pulled from the inboard side 30 of the rowing shoe 214 toward the outboard side 32 of the rowing shoe 214 after extending through the second strap ring 274.

In other words, in the second embodiment, both the first strap 38 and the second strap 240 are releasably attachable to the shoe upper portion 236 so as to tighten the shoe upper portion 236 to the wearer's foot when the free ends 88 and 108 of the first and second straps 38 and 240 are pulled from the inboard side 30 of the rowing shoe 214 toward the outboard side 32 of the rowing shoe 214.

Figure 15:
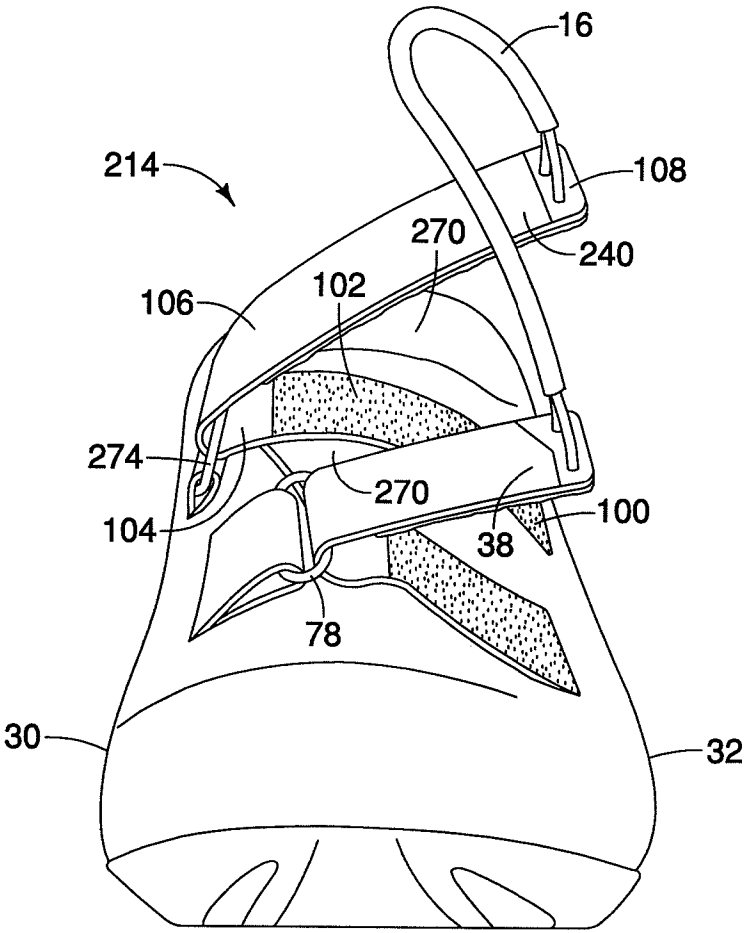
FIG. 15 is another front view of the rowing shoe depicted in FIGS. 12-14 showing the pair of straps loosened by pulling the pull rope in accordance with the second embodiment of the present invention.

The pull rope 16 is attached to both the first strap 38 and the second strap 240 and releases both of the first and second straps 38 and 240 by pulling the pull rope 16 upward from the outboard side 32 also pulling toward the inboard side 30, as indicated in FIG. 15.

Third Embodiment

Figure 16:
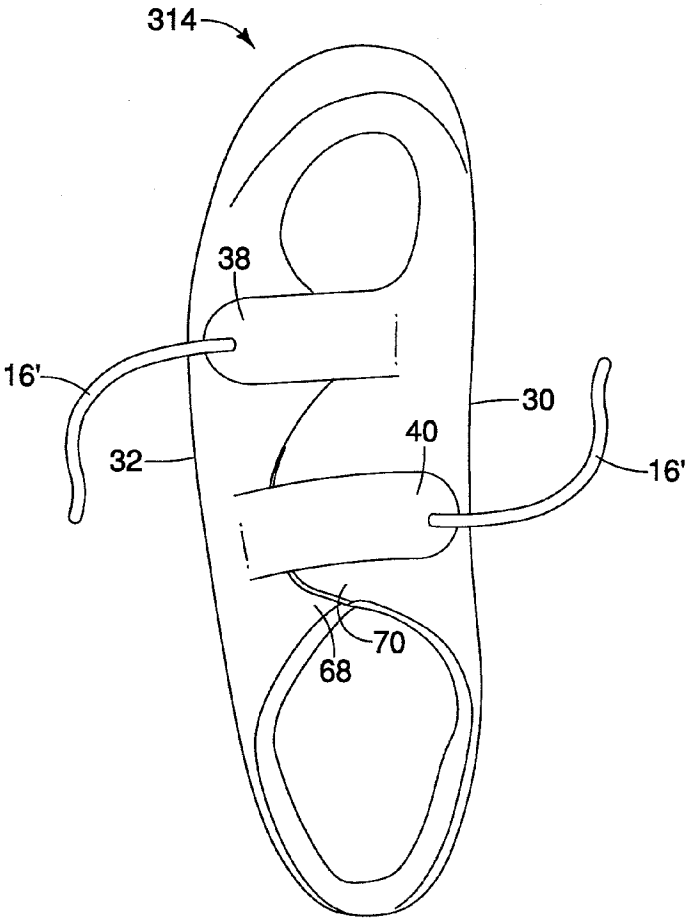
FIG. 16 is a top plan view of a rowing shoe showing free ends of a pair of straps that each include a corresponding pull rope in accordance with a third embodiment of the present invention.

Referring now to FIG. 16, a rowing shoe 314 in accordance with a third embodiment will now be explained. In view of the similarity between the first, second and third embodiments, the parts of the third embodiment that are identical to the parts of the first and/or second embodiments will be given the same reference numerals as the parts of the first embodiment. Moreover, the descriptions of the parts of the third embodiment that are identical to the parts of the first and/or second embodiment may be omitted for the sake of brevity.

In the third embodiment, the rowing shoe 314 has many of the features of the rowing show 14 of the first embodiment. For example, the rowing shoe 314 includes the inboard side 30, the outboard side 32, the sole 34 (not shown), the shoe upper portion 36, the first strap 38 and the second strap 40. However, in the third embodiment, the rowing shoe 314 includes two separate pull ropes 16' that replace the single pull rope 16. The pull ropes 16' can have overall lengths that are greater than the relative lengths depicted in FIG. 16 or can be shorter. The ropes 16' can be conveniently placed within easy reach of the rower R in order to smoothly release the straps 38 and 40 and smoothly free the rower R from the restraining force of the rowing shoes 14.

Fourth Embodiment

Referring now to FIG. 16, a rowing shoe 414 in accordance with a fourth embodiment will now be explained. In view of the similarity between the first, second and fourth embodiments, the parts of the fourth embodiment that are identical to the parts of the first and/or second embodiments will be given the same reference numerals as the parts of the first and/or second embodiment. Moreover, the descriptions of the parts of the fourth embodiment that are identical to the parts of the first and/or second embodiment may be omitted for the sake of brevity.

Figure 17:
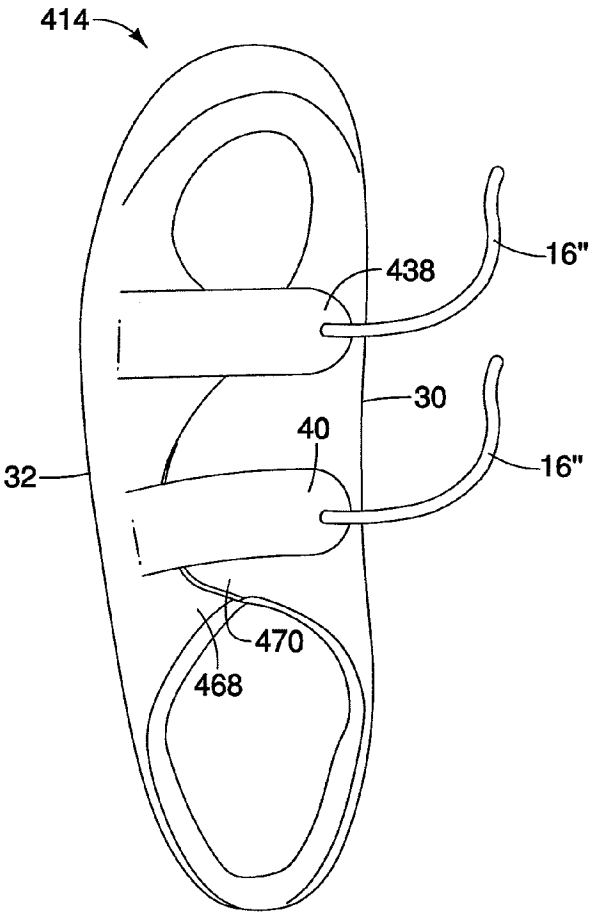
FIG. 17 is a top plan view of a rowing shoe showing free ends of a pair of straps that each include a corresponding pull rope in accordance with a fourth embodiment of the present invention.

In the fourth embodiment, the rowing shoe 414 has many of the features of the rowing show 14 of the first embodiment. For example, the rowing shoe 414 includes the inboard side 30, the outboard side 32, the sole 34 (not shown) and the second strap 40. However, in the fourth embodiment, the rowing shoe 414 has a first strap 438 that operates from the same sides of the rowing shoe 414 as the second strap 40. Further, there are two separate pull ropes 16" that replace the single pull rope 16. The pull ropes 16" can have overall lengths that are greater than the relative lengths depicted in FIG. 17 or can be shorter. The ropes 16" can be conveniently placed within easy reach of the rower R in order to smoothly release the straps 438 and 40 and smoothly free the rower R from the restraining force of the rowing shoes 14.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of a bicycle equipped with the present invention. Accordingly, these terms, as utilized to describe the present invention should be interpreted relative to a bicycle equipped with the present invention as used in the normal riding position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rowing shoe comprising:

a shoe sole having a cleat mounting portion configured so that a cleat structure is mountable thereto for releasably attaching to a binding structure of a rowing boat;

a shoe upper portion including at least one fixing strap configured to secure the shoe upper portion to a wearer's foot, the fixing strap having a proximal end fixed to the shoe upper portion and a free end having at least one aperture; and a release device having a pull rope extending through the at least one aperture of the free end of the at least one fixing strap.

2. The rowing shoe according to claim 1, wherein the shoe upper portion includes a pair of fixing straps, each of the fixing straps having a free end with at least one aperture and the pull rope extending between the free ends of the fixing straps with the pull rope further extending though each of the apertures.

3. The rowing shoe according to claim 2, wherein a first strap of the pair of straps is fixedly attached to the shoe upper portion and is releasably attachable to a first attachment section formed on the shoe upper portion so as to tighten the shoe upper portion to the wearer's foot when the free end of the first strap is pulled from one of outer and inner sides of the shoe toward the other of the outer and inner sides of the shoe, and a second strap of the pair of straps is fixedly attached to the shoe upper portion and is releasably attachable to a second attachment section formed on the shoe upper portion so as to tighten the shoe upper portion to the wearer's foot when the free end of the second strap is pulled from said the other of the outer and inner sides of the shoe toward said one of the outer and inner sides of the shoe.

4. The rowing shoe according to claim 3, wherein the first strap of the pair of straps is fixedly attached to the shoe upper portion and is releasably attachable to the first attachment section so as to tighten the shoe upper portion to the wearer's foot when the free end of the first strap is pulled from the inner side of the shoe toward the outer side of the shoe, and the second strap of the pair of straps is fixedly attached to the shoe upper portion and is releasably attachable to the second attachment section so as to tighten the shoe upper portion to the wearer's foot when the free end of the second strap is pulled from the outer side of the shoe toward the inner side of the shoe.

5. The rowing shoe according to claim 3, wherein the first strap is released from the first attachment section when the free end of the first strap is pulled from the inner side of the shoe toward the outer side of the shoe, and the second strap is released from the second attachment section when the free end of the second strap is pulled from the outer side of the shoe toward the inner side of the shoe.

6. The rowing shoe according to claim 3, wherein the free end of the first and second fixing straps includes one of a hook and loop fastener material and the first and second attachment sections include the other of the hook and loop fastener material.

7. The rowing shoe according to claim 3, wherein the pull rope includes a grip portion.

8. The rowing shoe according to claim 7, wherein the grip portion comprises a hollow metallic tubular member with the pull rope extending therethrough.

9. The rowing shoe according to claim 2, wherein the first fixing strap has a first length measured from an attachment point with the shoe upper portion to the free end thereof and the second fixing strap has a second length measured from an attachment point with the shoe upper portion to a free end thereto, the first length being greater than the second length.

10. The rowing shoe according to claim 2, wherein a first strap of the pair of straps is fixedly attached to the shoe upper portion and is releasably attachable to a first attachment section formed on the shoe upper portion so as to tighten the shoe upper portion to the wearer's foot when the free end of the first strap is pulled from one of outer and inner sides of the shoe toward the other of outer and inner sides of the shoe, and a second strap of the pair of straps is fixedly attached to the shoe upper portion and is releasably attachable to a second attachment section formed on the shoe upper portion so as to tighten the shoe upper portion to the wearer's foot when the free end of the second strap is pulled from said one of outer and inner sides of the shoe toward said the other of outer and inner sides of the shoe.

11. The rowing shoe according to claim 10, wherein the free end of the first and second fixing straps includes one of a hook and loop fastener material and the first and second attachment sections include the other of the hook and loop fastener material.

12. The rowing shoe according to claim 10, wherein the pull rope includes a grip portion.

13. The rowing shoe according to claim 12, wherein the grip portion comprises a hollow metallic tubular member with the pull rope extending therethrough.

14. The rowing shoe according to claim 1, wherein the pull rope includes a grip portion.

15. The rowing shoe according to claim 14, wherein the grip portion comprises a hollow metallic tubular member with the pull rope extending therethrough.

16. The rowing shoe according to claim 1, wherein the free end of the fixing strap includes one of a hook and loop fastener material and the proximal end of the fixing strap includes the other of the hook and loop fastener material.

17. A rowing shoe comprising:

a shoe sole having a cleat mounting portion configured so that a cleat structure is mountable thereto for releasably attaching to a binding structure of a rowing boat;

a shoe upper portion including a plurality of fixing straps configured to secure the shoe upper portion to a wearer's foot, each of the fixing straps having a proximal end fixed to the shoe upper portion and a free end with at least one aperture; and a pull rope extending between the free ends of the fixing straps with the pull rope further extending though each of the apertures.

18. A rowing shoe comprising:

a shoe sole having a cleat mounting portion configured so that a cleat structure is mountable thereto for releasably attaching to a binding structure of a rowing boat;

a shoe upper portion including a plurality of fixing straps configured to secure the shoe upper portion to a wearer's foot, each of the fixing straps having a proximal end fixed to the shoe upper portion and a free end having an aperture; and a pull release device extending between the free ends of the fixing straps and further extending though each of the apertures.

* * * * *